US010330436B2

(12) United States Patent
Romeo et al.

(10) Patent No.: US 10,330,436 B2
(45) Date of Patent: Jun. 25, 2019

(54) HANDGUN STORAGE SAFE

(71) Applicant: Hornady Manufacturing Company, Grand Island, NE (US)

(72) Inventors: Michael C. Romeo, Port St. Lucie, FL (US); David J. Carson, Stuart, FL (US)

(73) Assignee: Hornady Manufacturing Company, Grand Island, NE (US)

( * ) Notice: Subject to any disclaimer, the term of this patent is extended or adjusted under 35 U.S.C. 154(b) by 0 days.

(21) Appl. No.: 15/694,136

(22) Filed: Sep. 1, 2017

(65) Prior Publication Data

US 2018/0073836 A1 Mar. 15, 2018

Related U.S. Application Data

(60) Provisional application No. 62/383,164, filed on Sep. 2, 2016.

(51) Int. Cl.
*F41C 33/02* (2006.01)
*F41C 33/06* (2006.01)

(52) U.S. Cl.
CPC ..... *F41C 33/0263* (2013.01); *F41C 33/0272* (2013.01); *F41C 33/06* (2013.01)

(58) Field of Classification Search
CPC .. F41C 33/0263; F41C 33/0272; F41C 33/06; F41A 23/005; F41A 23/18; F41A 17/02
USPC ..... 70/63; 109/45, 50–52, 59 R
See application file for complete search history.

(56) References Cited

U.S. PATENT DOCUMENTS 1,430,081 A * 9/1922 Holler ..... B60R 7/14 224/281
1,557,339 A * 10/1925 Sander ..... B60R 7/14 224/542
3,419,728 A * 12/1968 Wilson ..... B60R 7/14 211/4
4,086,795 A 5/1978 Foster et al.
4,404,822 A 9/1983 Green
4,543,806 A 10/1985 Papandrea et al.
4,970,882 A 11/1990 Arrendondo
5,361,612 A 11/1994 Voiculescu et al.
5,408,212 A 4/1995 Meyers et al.
5,531,083 A 7/1996 Franck, III et al.
5,621,996 A * 4/1997 Mowl, Jr. ..... F41A 23/18 211/64
5,713,149 A 2/1998 Cady et al.
5,768,920 A 6/1998 DeBevoise
6,089,054 A 7/2000 Stukas et al.
6,192,719 B1 2/2001 Stukas et al.
6,223,461 B1 5/2001 Mardirossian
(Continued)

FOREIGN PATENT DOCUMENTS

CA 2047252 8/1993
EP 1092615 4/2001
(Continued)

*Primary Examiner* — Suzanne L Barrett
(74) *Attorney, Agent, or Firm* — McHale & Slavin, P.A.

(57) ABSTRACT

A gun safe is provided that has components configured to releasably retain a handgun in the safe. The safe includes a gun ejector mechanism, a gun retaining mechanism, and an activator mechanism. The components positively mechanically secure the gun in a retained condition until the activator effects release of the gun, and then the ejector effects movement of the gun from a retained position to a user access position.

10 Claims, 7 Drawing Sheets

(56) References Cited

U.S. PATENT DOCUMENTS 6,237,271 B1 5/2001 Kaminski
6,351,906 B1 3/2002 Honig, Jr. et al.
6,408,555 B1 6/2002 Sapia et al.
6,505,846 B1 1/2003 Hoffman
6,523,372 B1 2/2003 McDaid et al.
6,570,501 B2 * 5/2003 Bushnell ..... E05B 47/0002 206/1.5
6,581,421 B2 6/2003 Chmela et al.
6,595,031 B2 7/2003 Wilson et al.
6,681,603 B1 1/2004 Yu et al.
6,843,081 B1 * 1/2005 Painter ..... F41C 33/06 109/45
6,845,640 B2 1/2005 Loeff et al.
6,918,519 B2 7/2005 Vor Keller et al.
7,025,202 B2 4/2006 Jansen et al.
7,200,965 B2 4/2007 Vor Keller et al.
7,318,563 B2 1/2008 Houts
7,434,427 B1 * 10/2008 Miresmaili ..... F41C 33/02 109/47
7,448,156 B2 11/2008 Tucich
7,562,480 B2 7/2009 Mauch et al.
D617,525 S 6/2010 Taylor et al.
7,861,562 B2 1/2011 Tollefson
7,870,764 B2 1/2011 Burmesch
8,196,945 B2 6/2012 Hensley
8,228,192 B2 7/2012 Eckert et al.
8,418,391 B2 4/2013 Kemmerer et al.
8,499,804 B2 8/2013 Schulte
8,713,836 B1 5/2014 Haq
8,720,097 B2 5/2014 Derman
8,931,422 B2 * 1/2015 Heim ..... F41C 33/06 109/45
8,950,596 B2 2/2015 Arabian et al.
9,013,301 B2 4/2015 Williams
9,266,697 B2 2/2016 Houston et al.
9,293,019 B2 3/2016 Perreau et al.
9,303,950 B2 4/2016 Fuller
9,316,457 B2 * 4/2016 Hagedorn ..... F41A 27/30
9,328,536 B2 5/2016 Shute et al.
9,340,163 B2 * 5/2016 Baker ..... B60R 7/14
9,488,427 B1 11/2016 Lucero
9,500,441 B2 * 11/2016 Kirby, Jr. ..... F41C 33/06
9,534,867 B2 1/2017 Dunn et al.
9,624,711 B2 * 4/2017 McAlexander ..... E05G 1/02
9,719,286 B2 8/2017 Wall et al.
9,740,920 B1 8/2017 Chang et al.
10,040,401 B1 * 8/2018 Zalusky ..... B60R 7/14
2002/0158095 A1 * 10/2002 Vor Keller ..... E05B 47/0603 224/244
2002/0174587 A1 11/2002 Rumfelt
2004/0083778 A1 5/2004 Loeff et al.
2004/0237606 A1 12/2004 Iwamoto
2008/0134556 A1 6/2008 Remelin
2009/0223104 A1 9/2009 Anzeloni
2012/0085134 A1 4/2012 Ezzo et al.
2012/0210755 A1 8/2012 Shafer
2012/0291327 A1 11/2012 Boutot, Jr.
2013/0312306 A1 11/2013 Ruffin
2014/0110363 A1 4/2014 Brown et al.
2014/0215881 A1 8/2014 Milde, Jr. et al.
2014/0263107 A1 9/2014 Arabian et al.
2015/0198402 A1 7/2015 Brace
2015/0260480 A1 9/2015 Dunn et al.
2015/0337588 A1 11/2015 Kanhai
2016/0053526 A1 2/2016 Dittrich
2016/0054080 A1 2/2016 Haimi

FOREIGN PATENT DOCUMENTS

WO WO8300354 2/1983
WO WO9107560 5/1991

* cited by examiner

HANDGUN STORAGE SAFE

RELATED APPLICATIONS

In accordance with 37 C.F.R 1.76, a claim of priority is included in an Application Data Sheet filed concurrently herewith. Accordingly, the present invention claims priority to U.S. Provisional Patent Application No. 62/383,164, filed Sep. 2, 2016, entitled, "Handgun Storage Safe", the contents of the above referenced application is herein incorporated by reference in its entirety.

FIELD OF THE INVENTION

The present invention relates to a device for securely storing handguns and, in particular, a lightweight storage safe that allows for secure storage, restricted operation, and release of a stored handgun along with automated movement of a released gun from a stored position to an access position.

BACKGROUND OF THE INVENTION

Owning firearms for protection is popular for many around the world. Many handgun owners and collectors would like to keep a handgun at a convenient location and ready to use in case of need. However, this would typically have the handgun located where an unauthorized person could access the gun. It also results in a handgun being available for young and/or inexperienced people who might discharge the firearm accidentally.

Handgun safety devices are known, and include such things as trigger locks, cable locks, lock boxes and the like. While effective for preventing accidental use or misuse, they all preclude the immediate availability of a handgun in a time of need.

Single and multiple gun safes (sometimes called vaults) are known. They are designed for placement on a table or in a drawer in a convenient location. Storage devices are also available for vehicles. They are often constructed in the form of a box with a lid or door. They include a lock device, such as a digital lock or key lock, which provides security to the contents of the safe by preventing the lid or drawer from opening. While effective in limiting access to the contents, they also impede access to the contents if needed in an emergency. They may not store the gun in a consistent position inside. All prior art devices either preclude fast access to the stored gun or do not effectively secure the stored gun. Thus, storage security comes at the expense of fast access.

Another problem with firearm storage devices is that, although a firearm is readily accessible from storage to an owner, it is also readily accessible to small children. The lack of an encasing or safety locks makes for an attractive nuisance to young children. Thus, there exists a need for a way to safely and securely store firearms, and in particular handguns without the disadvantages described above.

DESCRIPTION OF THE PRIOR ART

StackOn, GunVault, Sentry Safe and Ivation are brands of handgun safes. Some use digital locks, some use key locks, and some use biometric information for security. All have the problem of not having fast gun access with storage security; and to date, none pass an ASTM test regarding gun retention ability.

SUMMARY OF THE INVENTION

A handgun safe for storing handguns is provided. The safe is comprised of an interior compartment which is defined by a plurality of walls, such as a bottom wall, a top wall, and a plurality of sidewalls. One of the walls may be a lockable door assembly. The door assembly may be a sidewall or top wall. The door assembly may be provided with any suitable lock arrangement including, but not limited to, radio frequency identification, lock and hasp, biometrics, combination, etc., that is suitable for selectively restricting access to the interior of the safe. The lock system also includes a retainer mechanism that stores the handgun in a locked retracted position and is operable to, upon activation, automatically move the handgun to a ready extended position.

Accordingly, it is an objective of the present invention to provide a handgun safe that allows a handgun to be stored in a secure non-use condition.

It is another objective of the present invention to provide a gun safe that is compact, and which securely stores a handgun in a secure retracted position while allowing easy access to the handgun in an extended access position.

Still another objective of the present invention is to provide a gun safe that uses an electronically operated retainer mechanism that selectively secures a handgun in a secure retracted position.

Yet another objective of the present invention is to provide a gun safe that will selectively move a handgun from its retained position to an extended position.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
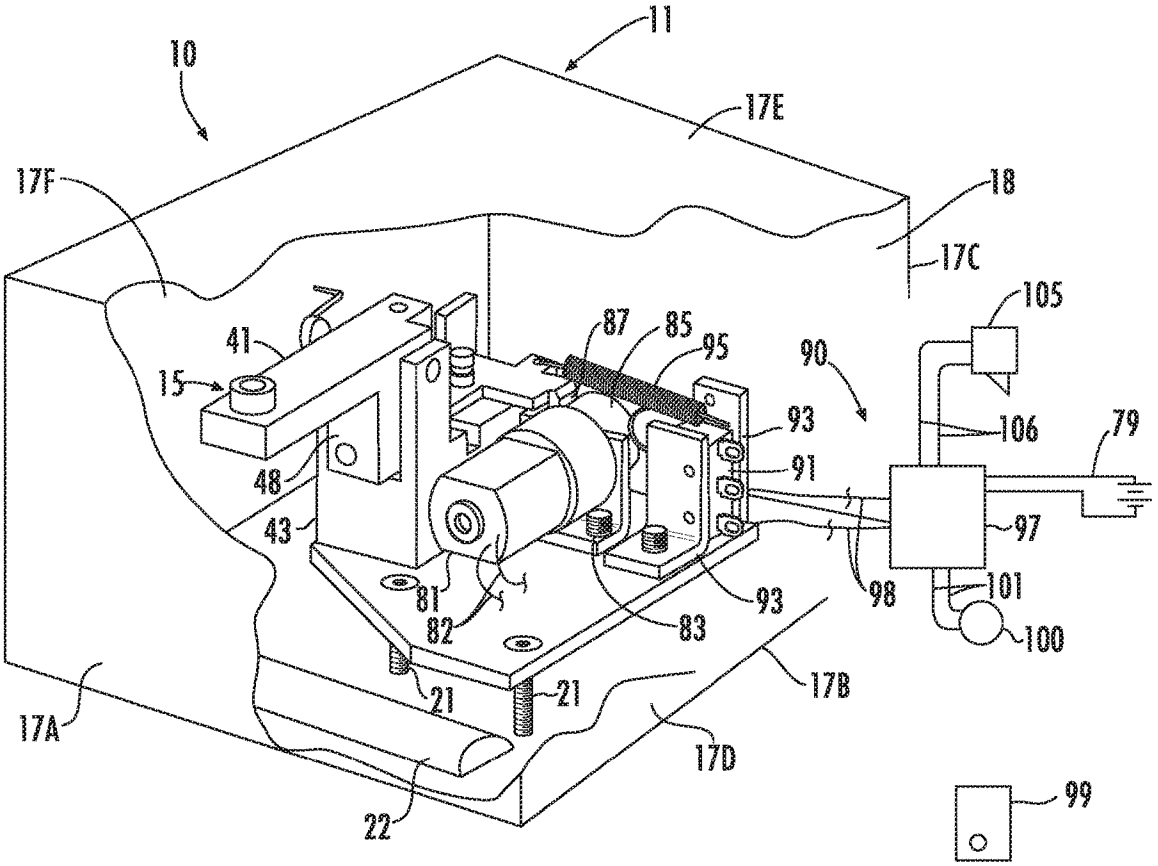
FIG. 1 is a fragmentary perspective view of a gun safe with portions broken away to show interior components and other portions not shown for clarity.

A gun safe, designated generally 10, is provided. It includes a shroud, designated generally 11, as an outer component to shield at least a portion of a handgun 12 from view and access. The safe 10 also includes an ejector mechanism, designated generally 14, operable upon activation to move the handgun 12 from a stored position to a ready access position for a user to grip a portion of the handgun and remove it from the shroud 11. The safe 10 is also provided with a retainer mechanism, designated generally 15, which is operable to selectively secure the handgun 12 in the shroud 11. The safe 10 is also provided with an activator mechanism, designated generally 16, that is operable to selectively activate portions of the retainer mechanism to allow it to move to a handgun release configuration.

In the illustrated structure, the shroud 11 includes a plurality of wall sections designated 17A, 17B, 17C, 17D, 17E and 17F. They are joined together in a manner to form an interior 18 for receipt of the handgun 12, the ejector mechanism 14, the retainer mechanism 15, and the activator mechanism 16. In a preferred embodiment, the shroud 11 is designed for use in a motorized vehicle, such as a car or truck, and does not need to have one end closed; for example, the wall 17C can be eliminated. In another embodiment, the shroud 11 can be in the form of a closed container by having an end wall 17C connected to the walls 17B, 17D, 17E and 17F. The wall 17A is movably mounted to one of the other walls 17, for example wall 17B, so as to be selectively movable between an open position and a closed position. A suitable latch mechanism 105, described below and shown schematically in FIG. 1, can be mounted to either the wall 17A or one of the other walls 17 to selectively maintain the wall 17A in its closed position, while allowing it to be moved to an open position either manually or automatically. If need be, the wall 17A can be associated with means to effect assisted opening, as for example a spring (not shown). Means may also be provided cooperating with the shroud 11 to effect mounting in a car or truck, or to a piece of furniture in a building. The walls 17 can be made out of any suitable material, such as a metal alloy and/or polymeric material. Preferably, for a polymeric material, a thermoset material or a high melting temperature thermoplastic is used.

In the illustrated structure, means is provided to associate the ejector mechanism 14, the activator mechanism 16 and the retainer mechanism 15 generally in fixed relationship to one another as described below. The illustrated means includes a plate 20 that is mounted to one of the walls 17 and, as shown, wall 17B, fixing the position of the plate 20 and the components mounted thereto in position inside the shroud 11. This can be accomplished as, for example, with threaded fasteners 21 and nuts or threaded holes in the wall to which the plate 20 is mounted. As shown, the wall 17B to which the plate 20 is mounted can have a riser 22 on which the grip 30 of the handgun 12 is mounted to facilitate the fingers of a user gripping the grip.

Figure 2:
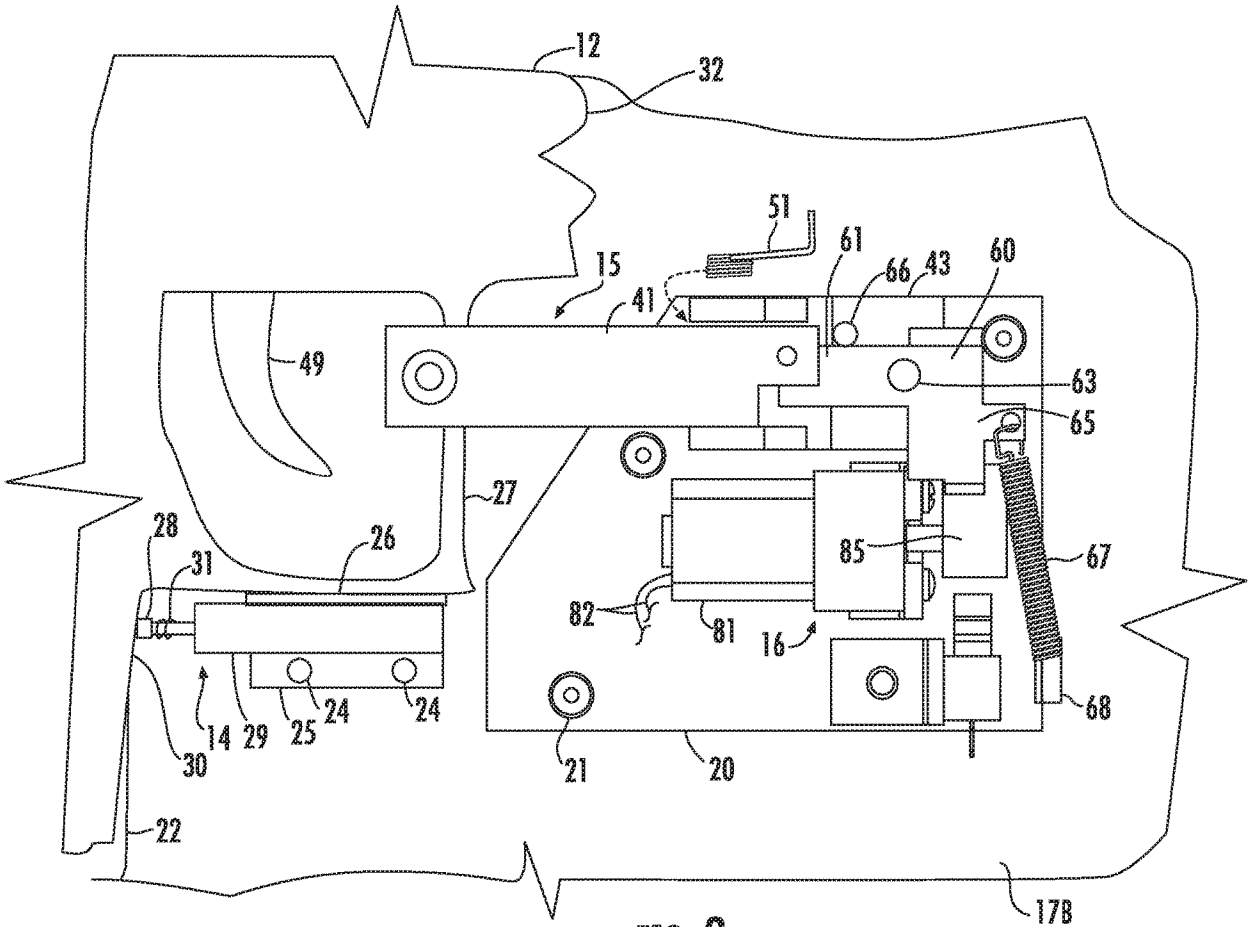
FIG. 2 is a fragmentary top plan view of a handgun retainer.

The ejector mechanism 14 is best seen in FIG. 2. The ejector mechanism 14 provides means for pushing the gun 12 in a direction from the muzzle of the gun to the grip of the gun, which would be from right to left in FIG. 2. In the illustrated structure, the ejector mechanism 14 is mounted to the wall 17B, as is the plate 20. The ejector mechanism 14 can also be mounted to the plate 20. The mounting can be accomplished by threaded fasteners 24 threaded into the wall 17B and through a base 25 of the ejector mechanism 14. A guide plate 26 can be provided to engage the trigger guard 27 of the handgun 12 to help maintain alignment of the handgun 12 within the shroud 11 and its position relative to the walls 17 and the plate 20. A plunger 28 is mounted for axial movement in a support 29, and is positioned for movement in a direction generally parallel to the barrel 32 of the handgun 12. The end of the plunger 28 is positioned for engagement, in a preferred embodiment, with the handgun grip 30 at a position adjacent the bottom of the trigger guard 27. The plunger 28 is spring loaded using a spring 31 that is under compression when the handgun 12 is retained in the safe 10. The plunger 28 is preferably movably mounted inside the spring 31. A preferred spring 31 is a coil compression spring. The guide plate 26 can be utilized to assist in moving the handgun 12 to its retained position by a person inserting the handgun 12 into the safe 10. The plunger 28, in the illustrated embodiment, is not connected to the retainer mechanism 15 or the activator mechanism 16, and operates independently thereof. It is also, preferably, solely a mechanical device.

Figure 3:
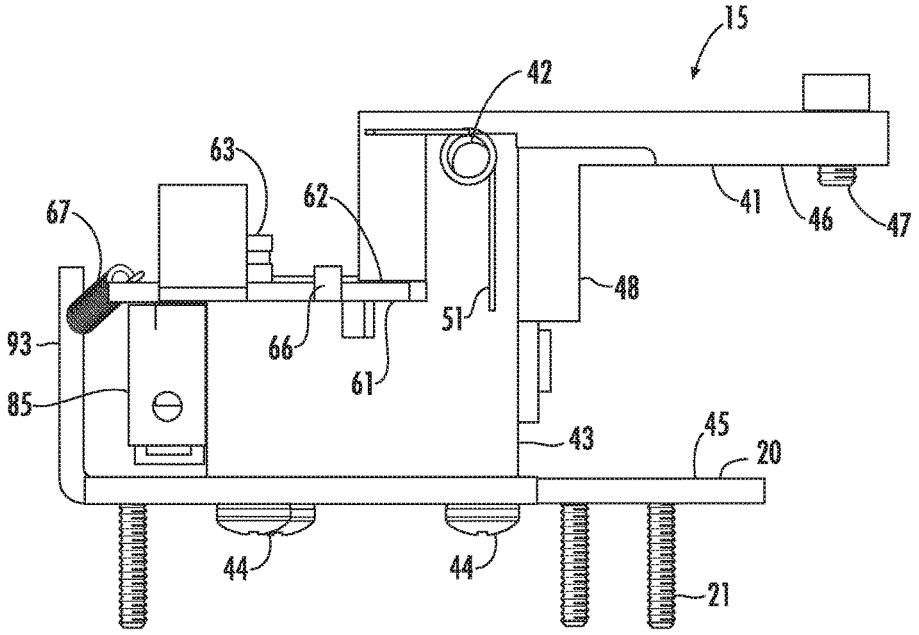
FIG. 3 is a side elevation view of the retainer seen in FIG. 2.
Figure 4:
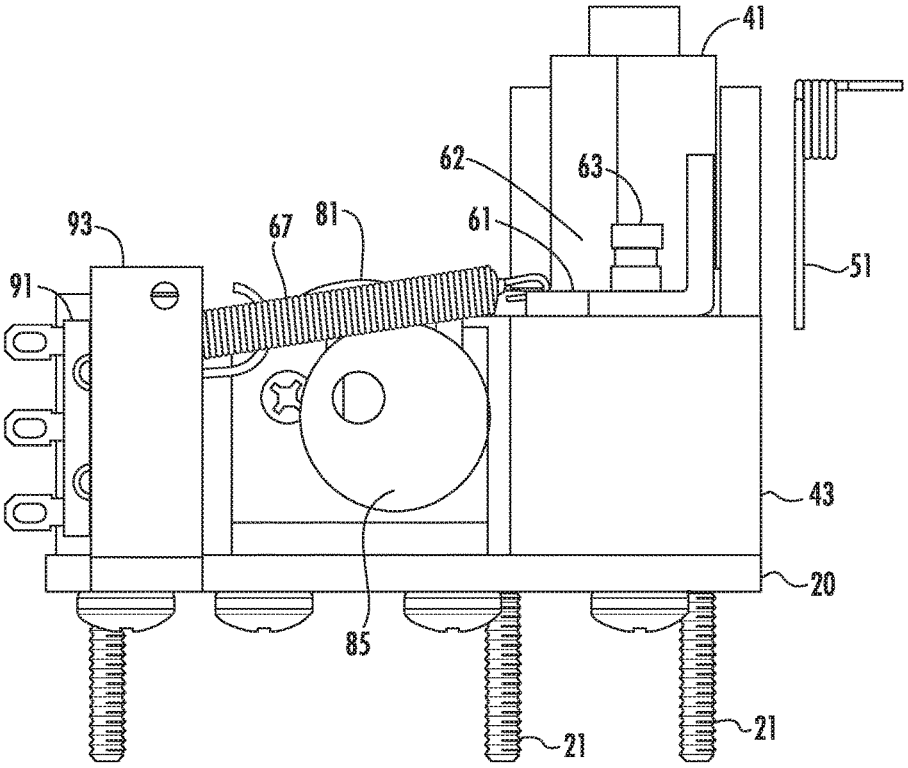
FIG. 4 is a rear end elevation view of the retainer seen in FIG. 2.
Figure 5:
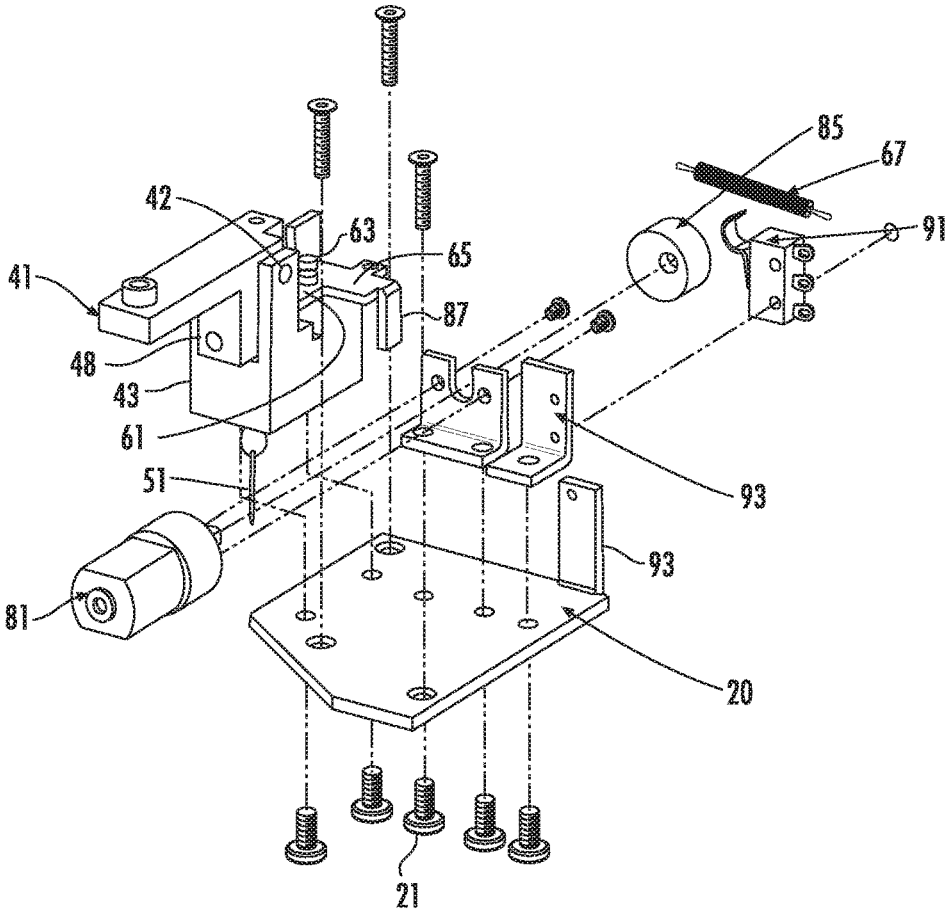
FIG. 5 is an exploded perspective view of the retainer seen in FIG. 2.

The retainer mechanism 15 is operable to releasably retain the handgun 12 in the safe 10 and, upon activation by the activator mechanism 16, to release the handgun 12 from retention, whereupon the ejector mechanism 14 will move the handgun to a non-retained position for easy access by a person. In the illustrated structure, the retainer mechanism 15 includes a pivotally mounted arm 41, as best seen in FIG. 3. The arm 41 is mounted on a pivot pin 42 that in turn is mounted on a stand 43 that is mounted to the plate 20 as with threaded fasteners 44. The arm 41 is positioned generally parallel to the plate 20 and is spaced therefrom a distance to have the handgun 12 fit between opposed surfaces, including the surface 46 of the arm 41 and surface 45 of the plate 20, thereby capturing the handgun 12. A projection 47, such as a finger, is mounted on the arm 41 and extends toward the surface 45 of the plate 20, and is positioned and adapted to be received inside the trigger guard 27 to selectively prevent movement of the handgun 12 from its retained position to a non-retained position. The retainer mechanism 15 also includes a leg 48 which depends from the arm 41 and is positioned for selective engagement with the front surface of the trigger guard 27. The leg 48 depends below the pivot pin 42, whereby, when the arm 41 is up and in its non-retaining position, movement of the leg 48 will move the arm 41 to its down or retained position. This movement can be accomplished by a person moving the handgun 12 from its non-retained position to its retained position, allowing the trigger guard 27 to move the leg 48 generally toward the stand 43, which in turn moves the arm 41 downwardly to its retaining position. The handgun 12 is captured between the finger 47 and leg 48. Means is also provided to cooperate with the arm 41 and leg 48 to selectively move the arm 41 to its up or non-retaining position, which allows the finger 47 to move out of the trigger guard 27 to release the handgun 12 from the selective retention. This can be accomplished through the use of a resiliently deformable member such as a two-legged torsion spring 51 (while the usual name is torsion spring, this is a misnomer, the spring portions are subject to bending stress, its application of force can cause a torque). The spring 51 is shown exploded for clarity. The spring 51 can be mounted to the stand 43, as by being positioned over a free end of the pivot pin 42 or mounted on the pin 42 between the arm 41 and a portion of the stand 43 as seen in FIG. 2, and positioned where bending stress in the coils of the spring 51 is partially released when the arm 41 is released for movement to the release position of the arm 41, wherein the spring 51 moves the arm 41 from its retaining position to its non-retaining position. In the illustrated structure, insertion of a handgun 12 into the safe 10 moves the front portion of the trigger guard 27 into engagement with the leg 48, effecting pivoting movement of the arm 41 from its non-retaining position to its retaining position with the finger 47 inside the trigger guard 27. It is to be understood that the spring 51 can be any form of resiliently deformable member such as a coil spring, a leaf spring or the like, that can apply force to the arm 41 to effect its movement to the release position from the retaining position. The arm 41, and hence the leg 48, which is preferably integral with the arm 41, are maintained in the gun retaining position, capturing the gun 12 within the safe 10 by use of means that positively locks the arm 41 in its retaining position until it is released. The ejector mechanism 14 is configured to act independently of the retainer mechanism 15 and in particular independent of movement of the arm 41 and projection 47.

Portions of the safe 10 in contact with the handgun, for example the arm 41, leg 48, finger 47, plate 20, riser 22 and wall 17B can be coated with a material to reduce marring or wearing off of the finish on the handgun 12. The material may also be of a type to reduce noise from handgun movement in the safe 10. Further, the arm 41 can have an end portion extend past the finger 47 positioned over the trigger 49 to preclude someone from pulling the trigger when the handgun is retained.

The retainer mechanism 15 cooperates with the activator mechanism 16 to positively mechanically lock the arm 41 in its gun retaining position, as seen in FIG. 3. That is, the arm 41 cannot be easily released, except for perhaps damaging components of the retainer mechanism 15. In the illustrated embodiment, the activator mechanism 16 includes a locking member 60 that includes a sear 61 that is in engagement with a latch 62 that is part of the retainer mechanism 15. The sear 61 is pivotally mounted to the stand 43, as with a pivot pin 63, which can be in the form of a shoulder bolt. The sear 61 moves in a plane generally perpendicular to the movement of the arm 41. The latch 62 selectively maintains its engagement with the sear 61 under the influence of torque provided by the torsion spring 51. As shown, the latch 62 is part of the leg 48.

The locking member 60 includes a leg 65 that is on the opposite side of the pivot pin 63 from the side where the sear 61 engages the latch 62, although other configurations could be used. Means is provided to bias the sear 61 to its position for engaging the latch 62, and engagement with a stop member 66 that limits pivoting movement of the sear 61 about the pivot pin 63. As shown, this means includes a coil tension spring 67 having one end fastened to the leg 65 and another end fastened to a bracket 68 suitably secured to the plate 20. Tension in the spring 67 biases the locking member 60 into engagement with a stop member 66, and in position under the latch 62. Thus, the sear 61 and leg 65 can be positively held in engagement, preventing the finger 47 from accidentally moving out of the trigger guard 27 as more fully described below.

The activator mechanism 16 includes means to selectively effect movement of the sear 61 out of engagement with the latch 62 to allow the arm 41 to move to its non-handgun retaining position. Preferably, this means is an electrically driven device and, as shown, includes a motor 81 that is electrically connected to a source 79 of electricity, such as a battery pack, house wiring or a vehicle electrical system. This connection can be via wires 82. The motor 81 is suitably mounted on the plate 20 as with threaded fasteners 83. The output rotary shaft of the motor 81 has a cam member 85 mounted thereon and is rotatable therewith, see FIG. 1. The cam 85 is an eccentric, best seen in FIG. 2, whereby, during one rotation of the cam 85, a follower 87, which is secured to and preferably integral with the leg 65, is forced to move. When the follower 87 is forced to move, it forces the leg 65 and sear 61 to rotate about the pivot 63, which effects movement of the sear 61 out of engagement with the latch 62. This then allows the arm 41 to pivot about the pivot pin 42, and the finger 47 to move out of its retention position in the trigger guard 27. The sear 61 is now in contact with a side of the latch retaining the sear 61, leg 65 and follower 87 in their rotated position. Preferably, the sizing of the cam 85 is such that it prevents any appreciable movement of the leg 65 and sear 61 unless the cam is rotating. This locks the sear 61 in positive mechanical engagement with the latch 62, preventing accidental release of the handgun 12 from retention in the safe 10.

The activator mechanism 16 includes an operation controller. The operation controller 90, seen schematically in FIG. 1, includes a switch 91 suitably mounted to the plate 20 by a pair of brackets 93. The switch 91 can be in the form of a micro limit switch having an actuator 95 that engages the cam 85 to open and close the switch 91 during one rotation of the cam 85. This arrangement allows the motor 81 to effect one rotation of the cam 85 during one cycle of operation. The cam 85 also effects terminating rotation of the motor 81. The switch 91 is also operably connected to a controller module 97 by wires 98. The controller module 97 is preferably one that provides secure operation only upon receiving a signal from a remote transmitter 99 that the safe 10 can be opened and the gun 12 released. This can be effected by the use of biometrics, using a suitable biometric sensor such as an eye scan, a fingerprint, or the like. In a preferred embodiment, a sensor 100 is operably connected to the module 97 by wires 101, and can be an RFID sensor that, when a coded RFID chip, for example located in the transmitter 99, is sensed as being within its range, the module 97 will send a signal to the switch 91 to effect operation of the motor 81 and release of the handgun from retention by allowing the finger 47 to move out of the trigger guard 27, wherein the ejector mechanism 14 effects outward movement of the handgun 12. The controller module 97 can also be operable to control a latch 105 operably associated with the wall 17A. The latch 105 is operably connected to the module 97 via wires 106 to allow the wall 17A to move to its open position upon operation of the latch.

While a motor 81 is shown as the electrically driven device, it is to be understood that other electrically driven devices can be used to move the sear 61. One such device is a solenoid.

The gun 12, after release, can be easily returned to the safe 10 for retention by simply moving the gun into the safe, using the guide plate 26 for positioning. Movement into the safe 10 puts the front of the trigger guard 27 into contact with the leg 48, urging the arm 41 to pivot and the finger 47 to move into the trigger guard. The sear 61 can then move under the latch 62 under influence of force from the spring 67, pivotally moving the sear 61 and leg 65 about the pivot 63. The follower 87 moves back into position for contact with the cam 85. The retainer mechanism 15 and activator mechanism 16 are thus reset for a subsequent operation. Movement of the gun 12 into the safe 10 also compresses the spring 31. The sear 61 now engages the latch 62 and locks the components into their gun retention configuration.

Figure 6:
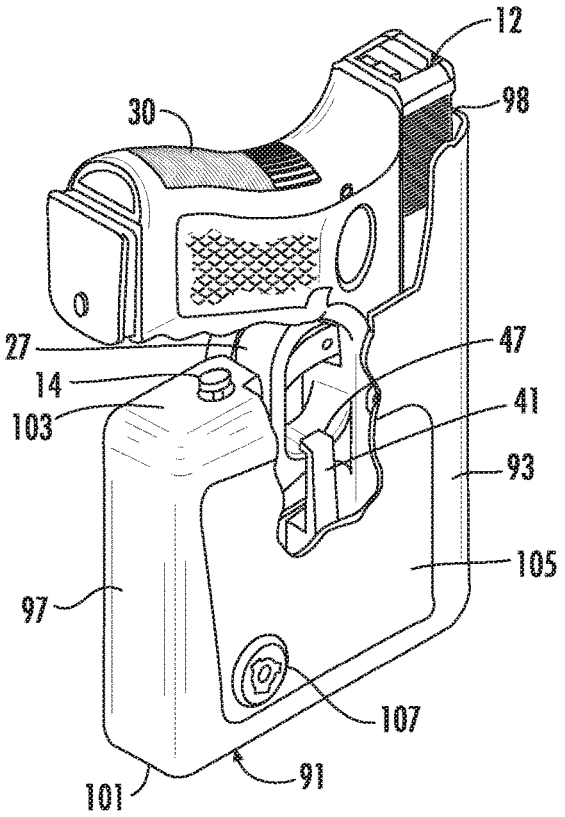
FIG. 6 is a fragmentary perspective view of an alternate embodiment of a gun safe utilizing a different shroud and a gun in a retained position.
Figure 7:
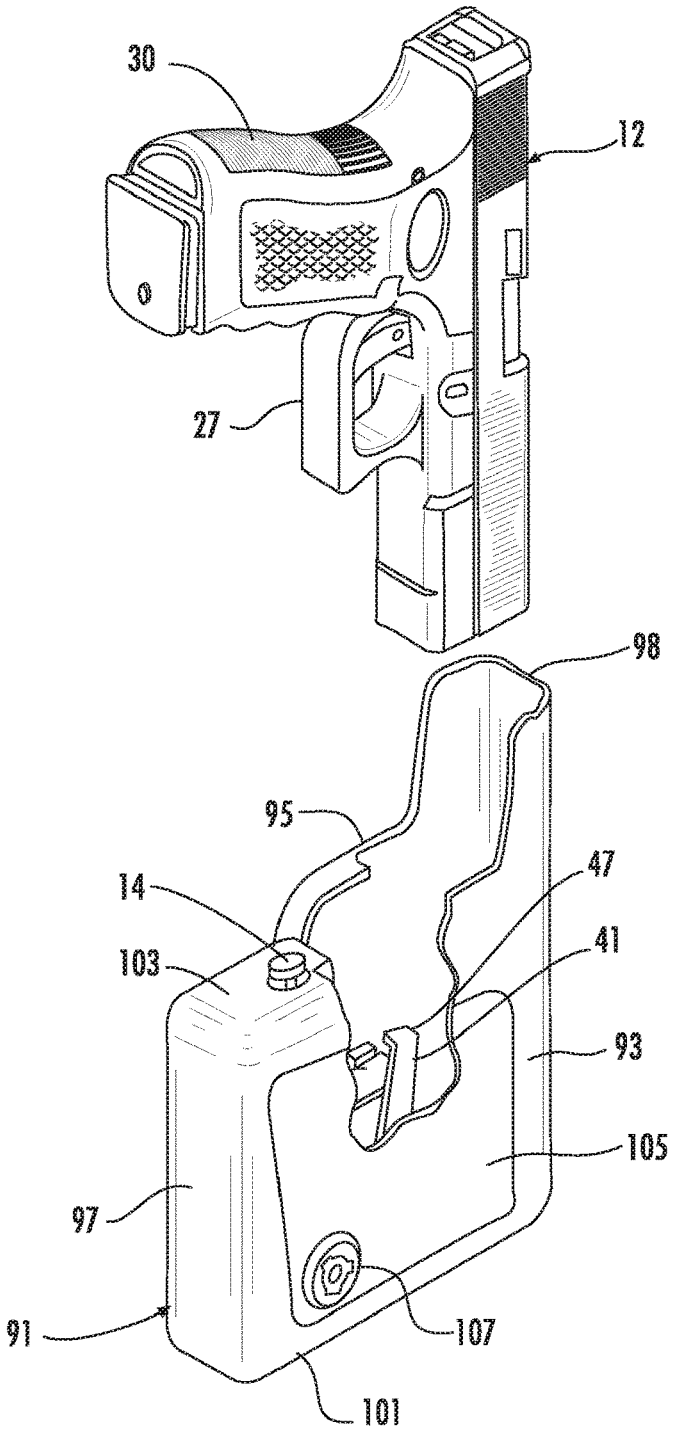
FIG. 7 is a fragmentary perspective view of the embodiment of FIG. 6 but with the gun removed.

FIGS. 6, 7 illustrate another form of the shroud 11, shroud 91. The shroud 91 uses the same components described above for retaining and releasing the handgun as does the shroud 11. The shroud 91 is shown in the shape of a holster, leaving the grip 30 exposed and other portions of the handgun 12 partially exposed. The shroud 91 can be constructed for mounting in a vehicle or the like as described above for the shroud 11. The shroud 91 can also be provided with means for mounting it for carry on a belt or the like, as well known in the art. As shown, the shroud 91 has a plurality of connected walls including front and back walls 93, 95 and side walls 97, 98. The shroud 91 includes a bottom wall 101 and top wall 103. The wall 93 can be provided with a door 105 that can be selectively opened and closed, as on a hinge, and secured in a closed configuration as with a key lock 107. The opening closed by the door 105 will provide access to the interior components, including a power source 79 as described above. The shroud 91 encloses a portion of the ejector mechanism 14, the retainer mechanism 15, and the activator mechanism 16 as described above. As shown, the ejector mechanism 14 has a portion extending through the wall 103 to engage the grip 30, but could be positioned internally to engage a forward portion of the trigger guard 27 when it is retained in the shroud 91.

The shroud 91 can be of molded construction using a polymer such as glass filled nylon. It can be molded in multiple pieces and joined together such as with snap lock connectors. The shroud 91 could also be molded in two major components, e.g., the wall 93 as part of one component and the wall 95 being part of another component; and these two major components being hingedly connected together and held together in a closed configuration by the lock 97, thus eliminating the need for the door 105.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A handgun securing device, said device including:

a shroud adapted for selectively containing at least a portion of a handgun therein;

an ejector mechanism associated with the shroud and operable to selectively move a handgun from a retained position to a released position;

a retainer mechanism associated with the shroud and operable to selectively retain at least a portion of a handgun within the shroud, said retainer mechanism including a retainer portion pivotally mounted in the shroud and being selectively movable between a handgun retaining position and a handgun release position into and out of a handgun trigger guard respectively, said retainer mechanism including a latch portion; and an activator mechanism associated with the retainer mechanism, said activator including an electrically driven device operable to selectively effect release of the retainer portion to move from its handgun retaining position to its handgun release position, said activator mechanism including a locking member coupling the electrically driven device to the retainer mechanism and operable to releasably retain the retainer portion in its handgun retaining position, said locking member being mounted for pivoting movement in the shroud and having a sear adjacent one end thereof, said sear being selectively engageable with said latch portion and in cooperation with the electrically driven device providing locking mechanical engagement to positively prevent movement of the retainer portion when in its retaining position until pivoting movement of the locking member by the electrically driven device.

2. The device of claim 1 wherein the electrically driven device including an electric motor with a rotatable output shaft and a cam mounted to the shaft and rotatable therewith.

3. The device of claim 2 wherein the being selectively moved by rotation of the cam to effect movement of the sear between a first position and a second position, and wherein said latch portion being positioned in its said first position for normal engagement with the sear to maintain the retainer portion in its handgun retaining position, and when the sear is moved to its second position by the cam, the latch portion moves effecting movement of the retainer portion to its handgun release position, whereby the ejector mechanism effects movement of a handgun to a released position.

4. The device of claim 3 including a first resiliently deformable member connected to the sear and operable to apply a biasing force thereto to induce movement of the sear from its second position to its first position and including a second resiliently deformable member connected to the retainer portion and operable to apply a biasing force thereto to induce movement of the retainer portion from its handgun release position to its handgun retaining position.

5. The device of claim 4 wherein the ejector mechanism is configured for movement independent of movement of the retainer portion.

6. The device of claim 5 wherein the retainer portion and the latch portion are connected and movable with one another and pivotally mounted in the shroud and wherein the retainer mechanism including a leg depending from the retainer portion and positioned to selectively engage a trigger guard of a handgun when in the shroud, whereby movement of a handgun into the shroud moves the leg to effect movement of the retainer portion to its handgun retaining position and the latch to a position to allow the sear to move to its first position under a biasing force of the first resiliently deformable member.

7. The device of claim 6 wherein the first and second resiliently deformable members being first and second springs respectively.

8. The device of claim 7 wherein the first spring being a coil spring and the second spring being a torsion spring.

9. The device of claim 6 wherein the activator including means to receive a signal from a transmitter to effect rotation of the motor.

10. The device of claim 1 wherein said retainer mechanism being pivotally mounted to move in a first plane and said locking member being pivotally mounted to move in a second plane, said first and second planes being generally perpendicular to one another.

* * * * *